US009214131B2

(12) United States Patent
Saatchi et al.

(10) Patent No.: US 9,214,131 B2
(45) Date of Patent: Dec. 15, 2015

(54) NON-VOLATILE DISPLAY ACCESSORY CONTROLLED AND POWERED BY A MOBILE DEVICE

(71) Applicant: CELLCO PARTNERSHIP, Basking Ridge, NJ (US)

(72) Inventors: Saeed S. Saatchi, Middletown, NJ (US); Sheela Thimmappa, Bridgewater, NJ (US); Ning Zhang, Warren, NJ (US)

(73) Assignee: Cellco Partnership, Basking Ridge, NJ (US)

( * ) Notice: Subject to any disclaimer, the term of this patent is extended or adjusted under 35 U.S.C. 154(b) by 165 days.

(21) Appl. No.: 13/844,284

(22) Filed: Mar. 15, 2013

(65) Prior Publication Data

US 2014/0267015 A1 Sep. 18, 2014

(51) Int. Cl.
*G09G 5/00* (2006.01)

(52) U.S. Cl.
CPC ..... *G09G 5/006* (2013.01); *G09G 2330/021* (2013.01); *G09G 2354/00* (2013.01); *G09G 2380/06* (2013.01)

(58) Field of Classification Search
CPC ..... G09G 5/00; G09G 5/006; G09G 2380/06; G09G 2354/00
USPC ..... 345/169, 1.1, 901, 905; 455/556.1, 455/556.2, 556, 574
See application file for complete search history.

(56) References Cited

U.S. PATENT DOCUMENTS

| | | | | |
|---|---|---|---|---|
| 6,726,164 | B1 * | 4/2004 | Baiza et al. | 248/222.12 |
| 2006/0197724 | A1 * | 9/2006 | Sakai | 345/87 |
| 2009/0164930 | A1 * | 6/2009 | Chen et al. | 715/769 |
| 2009/0267927 | A1 * | 10/2009 | Yun | 345/211 |

OTHER PUBLICATIONS

Electronic Paper, from Wikipedia, the free encyclopedia, 11 pages accessed on Feb. 5, 2013.

* cited by examiner

*Primary Examiner* — Shaheda Abdin

(57) ABSTRACT

A mobile device accessory includes an integrated non-volatile display (NVD) that uses substantially no power in order to maintain an image displayed thereon. A mobile device connected to the accessory controls the NVD by providing both image data for display on the NVD and power for powering of the NVD. In response to receiving a user-input command to display an image on the NVD, the mobile device transiently provides power to the accessory. While power is provided, the mobile device transmits the data for the image to the accessory. Once the image is displayed on the NVD, the mobile device substantially withdraws power provided to the accessory. Upon receiving a user-input command to update an image on the NVD, the mobile device again transiently provides power to the accessory for a limited period of time sufficient to provide and display the updated image on the NVD.

16 Claims, 5 Drawing Sheets

NON-VOLATILE DISPLAY ACCESSORY CONTROLLED AND POWERED BY A MOBILE DEVICE

BACKGROUND

In recent years, mobile communication services have expanded and increased in popularity and capabilities. Many advanced mobile devices are configured to perform functions beyond placing and receiving voice calls and sending and receiving mobile messaging service messages (e.g. text and/or multimedia). The mobile devices are capable of data communications, and are used to run a wide variety of applications. Applications include web browsers for surfing the world wide web, e-reader applications for reading e-books, mapping applications, document viewing applications (e.g., for displaying pdf files, documents, spreadsheets, slides), and the like.

The mobile devices are designed to be highly portable, and are therefore of limited size. The dimensions of built-in displays on the devices are correspondingly limited, and can only display a limited amount of information at any time. A user wanting to view a document, image, or book is therefore forced to either view the document/image/book with a very small font/feature size such that the entire document/image/book-page can be displayed on the screen, or view only a portion of the document/image/book-page at a time.

In addition, the built-in displays on the mobile devices consume non-trivial amounts of power when displaying an image. To conserve power, the mobile devices are generally configured to turn off the display screen after short periods of inactivity (e.g., 15 seconds). If the mobile device is used to display an e-book or other document for reading by a user, the automatic turning off of the display after the short period of inactivity interferes with the user's reading. Alternatively, the mobile device's continuous display of the e-book or document on the screen consumes large amounts of power and rapidly depletes the device's battery.

A need therefore exists for a mobile device accessory having an integrated display having very low power consumption, providing continuous display of information thereon, and that can be controlled and powered by the mobile device.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION

Figure 1A:
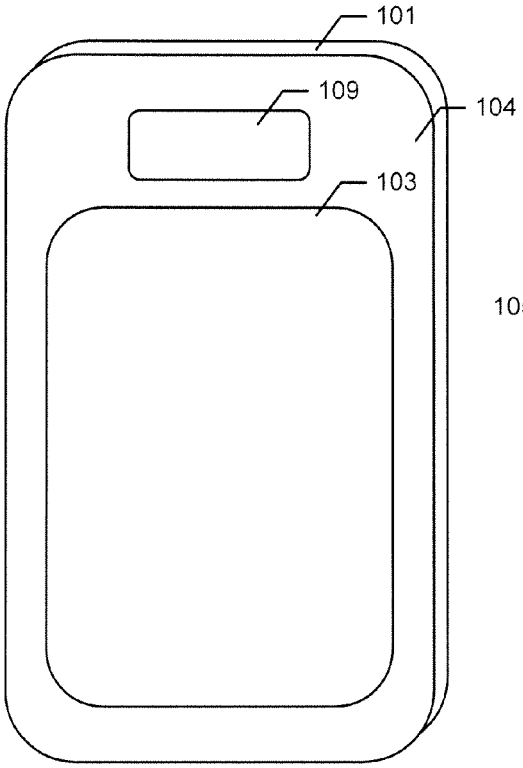
FIGS. 1A, 1B, and 1C respectively show front, rear, and bottom views of an illustrative mobile device accessory having an integrated non-volatile display (NVD).

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and/or circuitry have been described at a relatively high-level, without detail, in order to avoid unnecessarily obscuring aspects of the present teachings.

The various systems and methods disclosed herein relate to a mobile device accessory having an integrated non-volatile display, and to a method for a mobile device to control an external non-volatile display connected thereto.

An accessory for a mobile device includes a recess for accommodating a mobile device, and an integrated non-volatile display (NVD) located on a face of the accessory opposite to the recess. The NVD is a display that uses power in order to change an image displayed thereon, but uses substantially no power in order to maintain an image displayed thereon. The NVD can, for example, be an electronic paper display (EPD) which provides an image having a high contrast ratio suitable for reading in full sun conditions. The recess includes a device connector for removably connecting the mobile device to the accessory. The accessory further includes a display controller electrically coupled to the device connector and to the NVD, and configured to receive from the mobile device both image data for display on the NVD and power for powering of the NVD. The display controller is further configured to display the received image data on the NVD in response to receiving the image data and power through the device connector, and to maintain the display of the image data on the NVD when power is not received through the device connector. In one example, the accessory further includes a power connector for removably connecting a power supply to the accessory, wherein the power connector is coupled to the device connector so as to provide power to a mobile device connected to the device connector when power is received by the accessory through the power connector.

A mobile device having a built-in display, a user-input interface, and a connector, is configured to control an external non-volatile display (NVD) that is removably connected thereto via the connector. In particular, the mobile device is configured to, in response to displaying content on the built-in display, receive a user input command to display a particular image on the NVD. In response to receiving the user input command, the mobile device transmits image data corresponding to the particular image to the external NVD while transiently providing power to the NVD. In particular, the mobile device transiently provides power to the external NVD for a limited period of time including a time at which the image data is transmitted to the external NVD. Additionally, the mobile device can, responsive to receiving a user input command through a user interface component of the mobile device to change the particular image on the NVD, transmit image data corresponding to the changed image to the external NVD while transiently providing power to the NVD. Again, the mobile device transiently provides power to the external NVD to change the image displayed on the NVD for a limited period of time including a first time at which the image data is transmitted to the external NVD, including a second time at which the changed image data is transmitted to the external NVD, but provides substantially no power to the external NVD during a period of time between the first and second times.

The connector of the mobile device is configured to connect a peripheral device to the mobile device, wherein the peripheral device is one of the external NVD and a power supply. The mobile device is configured to detect whether the peripheral device connected to the connector is the external NVD or is the power supply, and to adjust the operation of the mobile device accordingly. In situations in which the connected peripheral device is the external NVD, the mobile device is further configured to determine whether the mobile device receives power from the peripheral device through the connector, for example in situations in which an external power supply is connected to the external NVD, or whether the mobile device should provide power to the peripheral device through the connector when providing image data for display on the external NVD.

Reference now is made in detail to the examples illustrated in the accompanying drawings and discussed below.

Figure 1B:
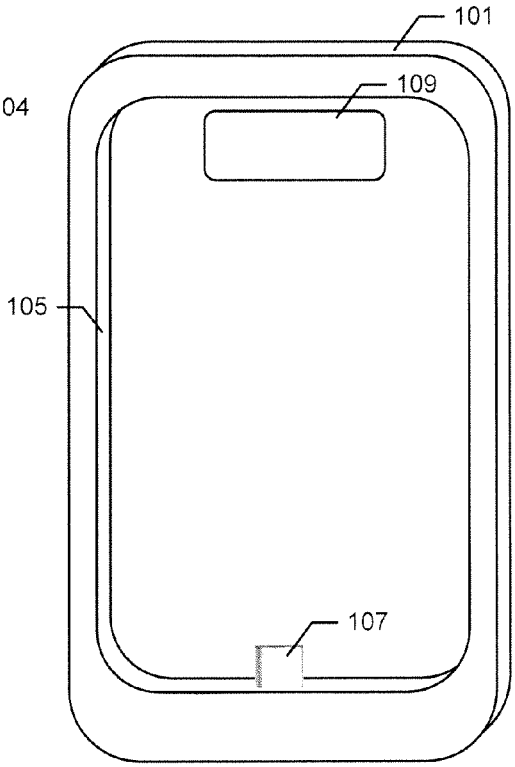
Figure 1C:
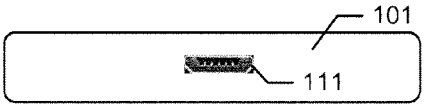

FIGS. 1A-1C respectively show a front view, a rear view, and a bottom view of an illustrative accessory 101 for a mobile device. The accessory 101 includes an integrated non-volatile display (NVD) 103 located on a front face 104 of the accessory 101. The NVD 103 occupies a major portion of the front face 104 of the accessory 101. The NVD 103 is a display that uses power in order to change an image displayed thereon (e.g., change a state of the display such that the image becomes displayed), but uses substantially no power in order to maintain an image displayed thereon (e.g., maintain a current state of the display in which the image is displayed). The NVD 103 is thus configured to display image data received from a mobile or other user device connected thereto, and to maintain display of the image data even when no power or substantially no power is received from the mobile device. The NVD 103 can, for example, be a display relying on electronic paper display (EPD) technology or other similar technology for operation, and generally provides an image having a high contrast ratio suitable for reading in full sun conditions. The NVD 103 provides ultra-low power usage and crystal clarity for readability in direct sunlight, and can be formed using a plastic or a flexible substrate in order to be shatterproof and durable. The NVD 103 optionally includes a backlight; however, in general an image displayed on the NVD is visible to a user without the use of the backlight.

The accessory 101 includes a recess 105 for accommodating a mobile or other user device connected thereto. The recess 103 is formed on a side of the accessory 101 opposite to the front face 104 having the integrated NVD 103. In one example, the recess 105 is shaped and sized to accommodate a particular type of mobile device, such as a particular make and model of mobile device. In another example, the recess 105 is shaped and sized to accommodate some number of different types of mobile devices within a range of compatible shapes and sizes, and can be used with connectors or inserts configured to hold each different type of device in the recess 105. The recess 105 can thus have a mobile device removably inserted therein, and may include retaining features to securely hold the mobile device in place within the recess 105 and accessory 101 when the device is inserted therein.

The accessory 101 further includes a device connector 107 which is configured to be coupled to a mobile device. The device connector 107 is generally attached in the recess 105 of the accessory 101, so as to electrically couple circuitry of the accessory 101 to a mobile device inserted in the recess 105. The connector 107 is operative to receive from a mobile device connected thereto both image data for display on the NVD 103 and power for powering the NVD 103. The connector 107 can be of an established connector type, such as a male micro-USB connector, that is complementary to a data-transfer and/or power connector of the mobile device. Other types, sizes, or configurations of connectors can also be used.

In the example shown in FIGS. 1A-1C, the accessory 101 for the mobile device further includes a through-hole or window 109 that is located and shaped so as to enable a camera and/or flash of a mobile device inserted into the accessory 101 to be used. For example, the through-hole or window is lined up with the camera and/or flash of the mobile device when the mobile device is inserted into the recess 105. The accessory 101 may further be shaped so as to enable a user to access keys or other user-interface components of a mobile device inserted into the recess 105, including a power key and/or volume up/down keys. The accessory 101 may also be configured such that the built-in display screen of a mobile device inserted into the recess 105 remains exposed, such that a user can view information displayed on the built-in display and/or interact with a touch-screen display when the device is in the accessory 101.

A power connector 111 can further be included on the accessory 101 for removably connecting a power supply to the accessory 101. The power connector 111, when included, is formed on an external side of the accessory 101, such as on a bottom side of the accessory 101 as shown in FIG. 1C. The power connector 111 is electrically coupled to the device connector 107, and is configured to provide power received from a power supply through the power connector 111 to a mobile device connected to the device connector 107.

Figure 2:
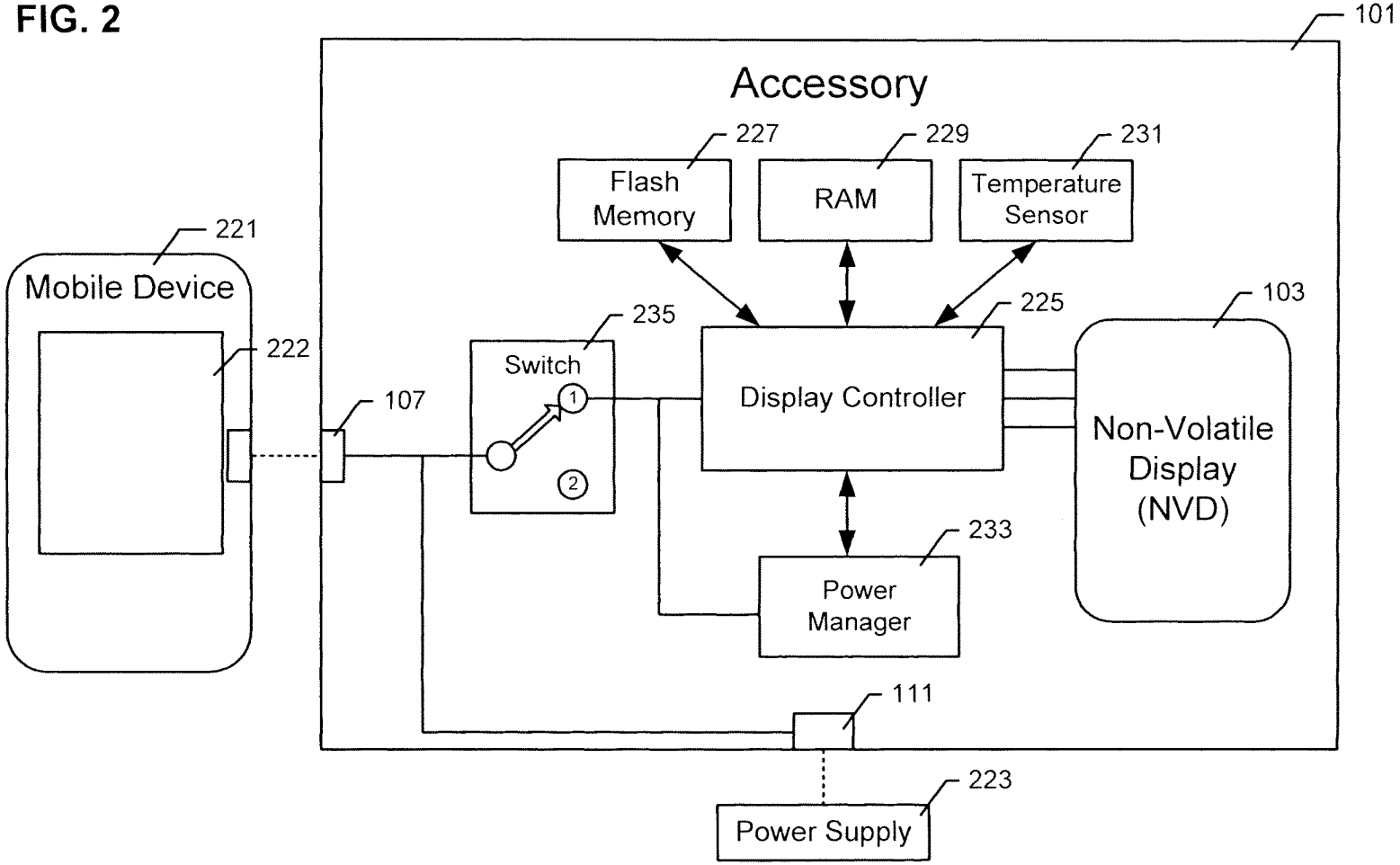
FIG. 2 is a schematic block diagram of a mobile device accessory having an integrated NVD and showing functional components of the accessory.

FIG. 2 shows a schematic block diagram of the accessory 101 illustratively showing connections between various components of the accessory 101. The components of accessory 101 shown in FIG. 2 are generally located within the body of the accessory 101 shown in FIGS. 1A-1C. The accessory 101 includes a display controller 225 coupled to both the device connector 107 and to the NVD 103, and configured to receive image data from a mobile device 221 coupled thereto via the device connector 107 and to control the NVD 103 so as to cause the NVD 103 to display the received image data. The display controller 225 is connected to a flash memory 227 and/or random access memory 229, which function as an image buffer and are used for storing image data (e.g., image data received from a connected mobile device 221) and program instructions for use by the display controller 225. The display controller 225 is further connected to a temperature sensor 231 used to monitor temperatures of the accessory 101, NVD 103, display controller 225, and/or other components of the accessory 101 and to cause the display controller 225 to cease operation if a temperature exceeds a maximum threshold.

During operation in an NVD mirroring mode, the accessory 101 is connected to a mobile device 221 having a built-in display 222 through the device connector 107. A switch 235 of the accessory 101 is in a first position (position "1", as shown in FIG. 2), such that image data transmitted form the mobile device 221 through the connector 107 is provided to the display controller 225. Additionally, power received from the mobile device 221 through the device connector 107 is provided to a power manager 233. The power manager 233 is operative to use the power received from the mobile device 221 to control operation of the accessory 101. The power manager 233 can, when sufficient power is received, provide power to the display controller 225, flash memory 227, RAM 229, temperature sensor 231, and/or NVD 103 in order to cause an image to be displayed and/or changed on the NVD 103. As shown in FIG. 2, the NVD 103 is external to the mobile device 221 but nonetheless displays image data received from the mobile device 221.

During operation in a charging mode, the accessory 101 is connected to both the mobile device 221 through the device connector 107 and to a power supply 223 through power connector 111. The power connector 111 is connected to the device connector 107 through accessory 101, such that power received from the power supply 223 is provided to the mobile device 221 through the connectors 107 and 111. When operating in charging mode, the switch 235 is generally in a second position (position "2"), such that the display controller 225, power manager 233, and other circuitry of the accessory are electrically de-coupled from and protected from power surges in the power supply 223.

Figure 3:
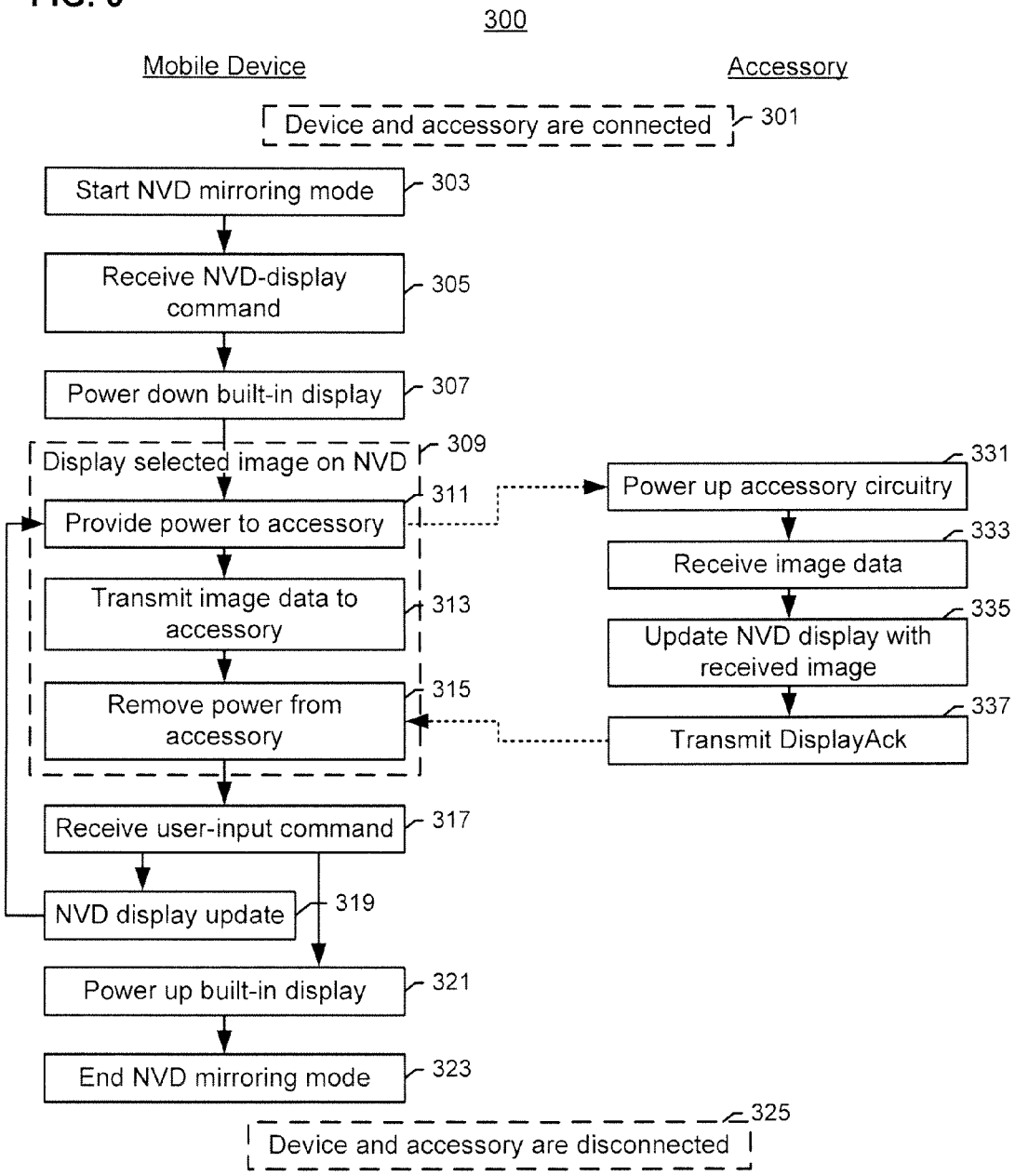
FIG. 3 is a flow diagram illustratively showing the operation of a mobile device accessory and of a mobile device that are connected together and operative to display image data on an NVD.
Figure 4:
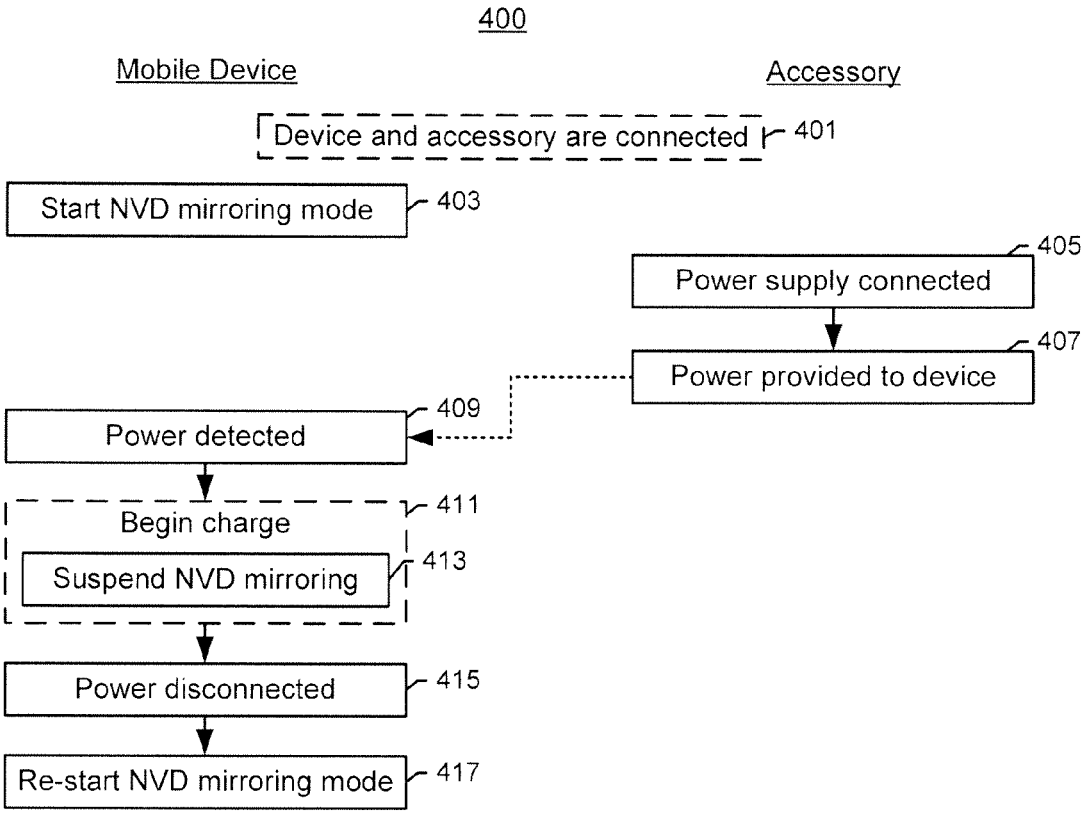
FIG. 4 is a flow diagram illustratively showing the operation of a mobile device accessory and of a mobile device that are connected together and operative to charge the mobile device.

The operation of the accessory 101, and of a mobile device 221 connected to the accessory 101, is described in more detail in relation to FIGS. 3 and 4.

FIG. 3 is a flow diagram illustratively showing the operation of an accessory 101 and of a mobile device 221 connected together and operating in the NVD mirroring mode. The method 300 begins with the mobile device 221 and accessory 101 being connected together through device connector 107 in step 301, and with the mobile device 221 entering an NVD mirroring mode in step 303. In one example, step 303 is performed automatically in response to the mobile device 221 being connected to the accessory 101 in step 301. In various other examples, however, step 303 may occur prior to step 301, or steps 301 and 303 may occur substantially concurrently. For example, step 303 can be performed in response to a user command input to the mobile device 221 to start the NVD mirroring mode either before or after connecting the mobile device 221 to the accessory 101. As part of step 303, the switch 235 of accessory 101 may, either automatically or in response to a command from the mobile device 221, move to the first position (position "1").

As part of entering the NVD mirroring mode in step 303, the mobile device 221 begins execution of a NVD manager service as a background service on the mobile device 221. In general, the NVD manager service does not significantly alter the operation of the mobile device 221 as experienced by a user, and a user may be unaware that the NVD manager service is running in the background. The user may continue interacting with and using applications on the mobile device 221 when the NVD manager service is operating. In some examples, however, an NVD manager service icon may be displayed on the mobile device's built-in display 222, menu options relating to the display of images on the NVD may be provided to a user of the mobile device 221, and/or the operation of certain keys on the mobile device 221 may be altered when the NVD manager service is running.

The mobile device 221 can be operated normally when operating in the NVD mirroring mode. As such, a user of the device 221 can place and receive phone calls, send and receive mobile messaging service (MMS) messages, and use various applications on the device such as an e-reader application, a document display (and/or editing) application, a web browsing application, a calendar application, a mapping application, or the like. As part of using such applications, the user selects content to be displayed as image data on the built-in display 222 of the mobile device 221, such as image data representing a page of a book, a document, spreadsheet, or slide deck, a calendar view, a web page, a map, or the like.

With the mobile device 221 connected to the accessory 101, and with the NVD mirroring mode activated on the mobile device 221, the user can also issue an NVD-display command through a user-input interface of the mobile device 221 in step 305.

In general, while operating in the NVD mirroring mode, the mobile device 221 is configured such that certain user-input interface buttons provide different functionalities than when the mobile device 221 is not operating in the NVD mirroring mode. Thus, in one example, keys of the mobile device 221 may be configured to provide NVD-mirroring related functionalities. In the example, the NVD-display command can thus be inputted by pressing a power button or other appropriate button or key on the mobile device 221 when operating in the NVD mirroring mode; additionally, the volume up and volume down buttons may be used to select a portion of an image displayed on the mobile device's built-in display 222 that should be displayed on the NVD 103 by enabling a user to scroll up or down on the image displayed to select the portion to be displayed. For instance, if the mobile device 221 is currently displaying a document or image, pressing of the volume up and volume down buttons concurrently may activate a display-select mode. Once in the display-select mode, the volume up and down buttons are used to resize and move a frame shown on the display, so as to place the frame over the portion of the document or image that should be displayed on the NVD 103 (e.g., to select only a portion of the document/image currently displayed on the built-in display 222, so as to provide a "zoom-in" view of the selected portion on the NVD 103; or to select more of the document/image than is currently displayed on the built-in display 222 so as to provide a "zoom-out" view of the selection portion on the NVD 103). Once the frame is sized appropriately and placed over the portion of the document/image desired to be displayed by the user, the user may press the power button to cause the selected portion to be displayed on the NVD 103.

Alternatively or additionally, options displayed on the built-in display 222 and/or on a touch-screen input device associated with the built-in display are configured to provide NVD-mirroring related functionalities. Thus, a user may input the NVD-display command by selecting an NVD-display option in a menu displayed on the built-in display 222 (e.g., by clicking or pressing an menu icon on the built-in display to activate the menu, and clicking or pressing the appropriate NVD-display menu option once the menu is displayed) or by selecting an NVD-display icon on the built-in display 222 of the mobile device 221 (e.g., an NVD-display icon that is over-laid over a corner of an image displayed on the screen when the NVD mirroring mode is active). The menu may, in addition to the NVD-display option, provide other options relating to control of the NVD 103. For instance, the menu may include an option to "select a view" in order to select a portion of a document or image to be displayed on the NVD 103 (e.g., in a manner similar to that described above in relation to the display-select mode, but using touch-screen input functionalities in addition to or instead of the selection of key presses described above), an option to "adjust display settings" for the NVD in order to select a minimum font size and/or a preferred font size for display on the NVD 103 (e.g., in the case of an e-book, spreadsheet, or other document selected for display). In other examples, the user can input the NVD-display command(s) through other appropriate means.

In response to receiving the NVD-display command, the mobile device 221 begins processing to cause image data to be displayed on the NVD 103. These steps may involve powering down the built-in display 222 of the mobile device 221, as shown in step 307. The built-in display 222 of the mobile device 221 may be powered down immediately in response to receiving the NVD-display command, powered down once the image data is displayed on the NVD 103 (e.g., after step 309), powered down after a time-out period has expired (e.g., after 10 seconds of inactivity following the receipt of the NVD-display command or other user-input), or in response to another appropriate trigger.

In response to receiving the NVD-display command, the mobile device 221 further causes selected image data to be displayed on the NVD 103 external to the mobile device 221 in step 309. The selected image data generally corresponds to data for all or a portion of an image displayed on the built-in display 222 of the mobile device 221 at the time the NVD-display command was issued, thereby causing the built-in display 222 to be copied or "mirrored" onto the NVD. In an alternate embodiment, however, the selected image data may correspond to data for another user-selected image, such as data for displaying a document identified by the user as part of the NVD-display command. The display of image data on the NVD 103 can include multiple steps, as detailed in steps 311-315.

For instance, in step 311, the mobile device 221 begins providing power to the accessory 101 through the device connector 107. In particular, the mobile device 221 may cause switch 235 to assume the first position (position "1" of FIG. 2), such that power provided by the mobile device 221 through connector 107 is provided to the power manager 233. In response to receiving power, the power manager 233 may cause display controller 225, flash memory 227, and RAM 229 to be powered up in step 331.

In turn, in step 313, the mobile device 221 transmits the selected image data to the display controller 225 through connector 107, causing the display controller 225 to receive the selected image data (step 333). The transmitting of the selected image data can include the sending of the contents of an image buffer storing image data displayed on the built-in display 222 of the mobile device 221 to the accessory 101, so as to replicate or mirror the image from the built-in display 222 on the NVD 103. Alternatively or additionally, the transmitting can include preparing image data for display on the NVD 103, for example by computing image data for causing the display of a selected document or image on the NVD 103, adjusting image data for display on the NVD 103 in order to conform to display properties of the NVD 103 (e.g., adjusting image data to conform to display size and resolution parameters, to minimum font size limitations, etc.), or the like. In response to receiving power and to receiving the selected image data, the display controller 225 updates the NVD 103 display with the received image (step 335). The updating of the NVD 103 display may involve causing power manager 233 to power up the NVD display 103, and display controller 225 concurrently providing the selected image data to the NVD 103 while power is being provided so as to change a state of the NVD 103 and cause the selected image to be displayed on the NVD.

Once the selected image data is displayed on the NVD 103, the mobile device 221 substantially removes power from (or substantially stops providing power to) the accessory 101 in step 315. In one example, power is substantially removed in response to receiving a DisplayAck signal from the accessory 101, wherein the DisplayAck signal is transmitted by the accessory 101 to the mobile device 221 in step 337. The DisplayAck may be transmitted once the NVD 103 has been updated to display the selected image data, and once the NVD 103 no longer uses power to continue display of the selected image data on the NVD 103. In another example, power is substantially removed after a time-out period has expired (e.g., 2 seconds after completion of step 313), or once current flow from the mobile device 221 to the accessory 101 is negligible or below a minimum threshold. In some examples, all power is removed or stopped being provided to the accessory 101 in step 315. In other examples, however, the mobile device 221 substantially withdraws power provided to the accessory 101 in step 315, such that substantially no power is provided to the accessory 101 following completion of step 315.

Following completion of steps 311, 313, and 315, the NVD 103 displays the selected image data. Because the NVD 103 uses substantially no power in order to maintain display of an image thereon, the selected image data remains displayed even though little or no power is supplied to the accessory 101 or NVD 103 following completion of step 315. As such, the selected image data remains displayed until a change in display is requested. A change in display is made only when power is received by the NVD 103 through the device connector at the same time as image data for a new image is received through the device connector.

When operating in the NVD mirroring mode, and following display of the selected image data on the NVD 103 in step 309, the mobile device 221 performs certain actions in response to receiving user-input commands. In step 317, the mobile device 221 receives a user-input command through a user-input interface of the mobile device 221. In general, the user-input command may be a press or click of a key on the mobile device 221. In some examples, however, user-input commands may be received through a touch sensor mounted to a built-in touch-screen display of the mobile device 221. Depending on the user-input command received, operation of the mobile device 221 may proceed differently.

In step 319, in response to receiving a user-input command for performing an NVD display update, the mobile device 221 determines an updated image to display on the NVD and causes the updated image to the displayed on the NVD by looping back to step 309. The user-input command causing an NVD display update may be a user command to scroll-up or to scroll-down (or, alternatively, to scroll-left or to scroll-right) along the image currently displayed on the NVD. The user-input command causing an NVD display update may alternatively be a user command to turn a page (e.g., page-up or page-down) in a book or other document currently displayed on the NVD, or a user command to zoom-in or to zoom-out (e.g., in a book, map, or other document). In one example, a single press of a volume up or volume down button of the mobile device may correspond to a scroll up or scroll down command, while a double press of the volume up or volume down button may correspond to a page up or page down command. The mobile device 221 determines the updated image to be displayed in response to the user-input command, and provides the updated image for display in step 309. In accordance with the description of step 309 above, the display of the updated image on the NVD 103 may include steps for providing full power to the accessory 101 (step 311), transmitting the updated image data to the accessory 101 while power is provided to the accessory 101 (step 313), and substantially removing power from the accessory 101 once the updated image is displayed on the NVD 103 (step 315).

Other types of user-input commands may also be received in step 319. The commands may be inputted by pressing keys on a user-input interface of the mobile device 221, wherein each key is linked to a corresponding command; by temporarily re-activating the built-in display 222 of the mobile device 221 to have a menu of options displayed thereon for selection, and enabling the user to select an option from the menu (e.g., through a touch-screen user-input interface); by causing a menu of options to be displayed by the mobile device 221 on the NVD 103 and enabling a user to use the volume up/down and power keys of the mobile device 221 to highlight and select a desired option from the menu; or by other appropriate sequences of user-input selections. In an example, the other types of user-input commands include a "clear" command, received for example through the selection of a "clear" option from a user-input menu presented to the user on either the NVD 103 or on the built-in display 222. Selection of the "clear" option may cause the screen of the NVD 103 to be cleared of any image displayed thereon, e.g. by transmitting a blank image for display to the NVD 103 (and sufficient power to cause the blank image to be displayed) or by otherwise resetting or erasing the image currently displayed on the NVD 103. A "refresh" command may cause the same image data currently displayed on the NVD 103 to be re-transmitted to the NVD 103 (along with sufficient power to cause the same image data to be re-displayed on the NVD 103), so as to address situations in which the image displayed on the NVD 103 may have become corrupted. Commands to "zoom-in" or "zoom-out." "scroll-left" or "scroll-right," to "follow link" or "follow hyperlink," or the like may also be available to the user.

In step 321, in response to receiving a user-input command to re-activate the built-in display 222 of the mobile device 221 or to exit the NVD mirroring mode, the mobile device 221 powers the built-in display 222 back up. Once powered back up, the built-in display 222 can show an image (or portion of an image) last displayed on the NVD 103, or the built-in display 222 can show a menu screen, home screen, or other appropriate screen in response to the command to re-activate the built-in display 222. The user-input command of step 321 may be a press of a power button on the mobile device 221, for example. A user may then select to end the NVD mirroring mode in step 323, and the device 221 and accessory 101 can be disconnected in step 325 by removing the mobile device 221 from the recess 105 of the accessory 101. In one example, the removal of the mobile device from the recess of the accessory (step 325) causes steps 321 and 323 to be performed automatically.

While the method 300 has described an illustrative flow in which the built-in display 222 of the mobile device 221 is powered down while image data is transmitted for display on the NVD (see, e.g., steps 307/321), in some examples the built-in display is not powered down. For example, a user may activate an "extended-screen" command (e.g., through selection of an "extended-screen" menu option) so as to cause image data to be displayed both on the built-in display 222 and on the NVD 103 concurrently. In the "extended-screen" mode, different images are generally displayed on the built-in display 222 and on the NVD 103. In one example, sequential pages of a document are displayed on each display, such that for example page n of the document is displayed on the built-in display 222 while page n+1 of the document is displayed on the NVD 103. In another example, different selected pages (e.g., not necessarily sequential pages) or different portions of a document or image are shown on each of the built-in display 222 and NVD 103. The different selected pages or portions may further be selected from the same document (e.g., pages m and n of a document) or of different documents (e.g., page m of a first document, page n of a different document). In a further example, a zoomed-in view of a selected portion of a document/image is shown on the NVD 103, while the wider view of the document/image is shown on the built-in display 222, and a user may move a frame shown on the built-in display 222 (e.g., using touch-screen functionalities) so as to cause a different portion of the wider view to be zoomed-in on in the NVD display.

The mobile device 221 may be configured to lock-up its user-input interface after a pre-determined period of inactivity, so as to reduce instances in which a user of the mobile device inadvertently touches the user-input interface and causes an un-intended input or command to be processed by the mobile device. When operating in the NVD mirroring mode, however, the mobile device 221 may be configured not to lock-up its user-input interface so as to enable a user to issue certain user-input commands (e.g., in step 317), or to at least leave certain portions of the user-input interface unlocked (e.g., certain keys of the mobile device may be unlocked and actively respond to user input, while a touch-sensor associated with the built-in display of the mobile device may be de-activated and/or locked).

In addition, in some examples, the mobile device 221 may be operative to keep the NVD-initiating application (e.g., the application from or for which the NVD-display command was received in step 305) as the foreground task during NVD mirroring mode, and to thereby prevent the NVD-initiating application from being relegated to a background operation status. In other examples, however, the NVD-initiating application may be relegated to background processing when the mobile device 221 receives a phone call, receives a mobile messaging service (MMS) message, and/or an alarm is activated on the mobile device 221 (e.g., a scheduled alarm). In the other examples, the interrupting application (e.g., the phone, MMS, and/or alarm application) may cause the NVD-initiating application to be temporarily relegated to background processing for a period of time (e.g., the duration of the phone call, or until the interrupting application is exited), during which the mobile device 221 behaves as it normally does when executing the interrupting application (e.g., the volume up/down keys control the volume of a speaker and a built-in display 222 is turned on and displays the incoming phone number, MMS message, or alarm message). However, as soon as the interrupting application exits or completes the task having caused the interruption, the mobile device 221 returns to the NVD mirroring mode such that for example the built-in display 222 is powered down (e.g., as in step 307) and pressing of the volume up/down keys results in an update of the NVD 103 display with an updated scrolled up/down display image (e.g., as in steps 317/319).

FIG. 4 is a flow diagram illustratively showing the operation of an accessory 101 and of a mobile device 221 when a power supply is connected to the accessory 101. The method 400 begins with the mobile device 221 and accessory 101 being connected together via device connector 107 in step 401, and with the mobile device 221 entering the NVD mirroring mode in step 403. Steps 401 and 403 may be substantially similar to steps 301 and 303 of method 300, and reference can be made to the description of method 300 for detailed information on the steps.

In step 405, a power supply 223 is connected to the accessory 101 by coupling of the power connector 111 to the power supply 223. In one example, in response to the connection of the power supply 223, the switch 235 automatically detects the connection of the power supply 223 and causes the switch 235 to move to the second position (position "2") so as to ensure that power from the power supply 223 does not cause damage to the display controller 225, power manager 233, or NVD 103. In another example, the switch 235 is controlled by the mobile device 221, and the switch 235 is moved to the second position in response to the mobile device 221 sending a command to the switch 235 upon detecting the connection to the power supply 223 (e.g., in step 409).

In response to the connection of the power supply 223, power provided by the power supply 223 to power connector 111 is routed through the accessory to the device connector 107. In turn, a mobile device 221 coupled to the device connector 107 receives the routed power via the connector 107 in step 407. The mobile device 221 may automatically detect the connection of the power supply (step 409), and begin a charging process (step 411) in response to the automatic detection. The mobile device 221 may additionally, in response to detecting the connection of the power supply 223 and/or to starting the charging process, temporarily suspend or disable the NVD mirroring mode while the power supply 223 is connected (step 413). As a result of the NVD mirroring mode being suspended, the mobile device 221 may be unable to display information on the NVD 103 or to update an image on the NVD 103 during the charging process. Once the power supply is disconnected from the accessory 101 in step 415, the NVD mirroring mode is re-started in step 417 such that the mobile device 221 can once again cause information to be displayed on the accessory 101. For example, once the NVD mirroring mode is re-started, the mobile device 221 can cause an image to be displayed or updated on the accessory 101 by following steps 305-319 of method 300. In addition, once the power supply 223 is disconnected from the accessory 101 in step 415, the switch 235 may automatically or in response to a communication from the mobile device 221 move to the first position (position "1").

Figure 5:
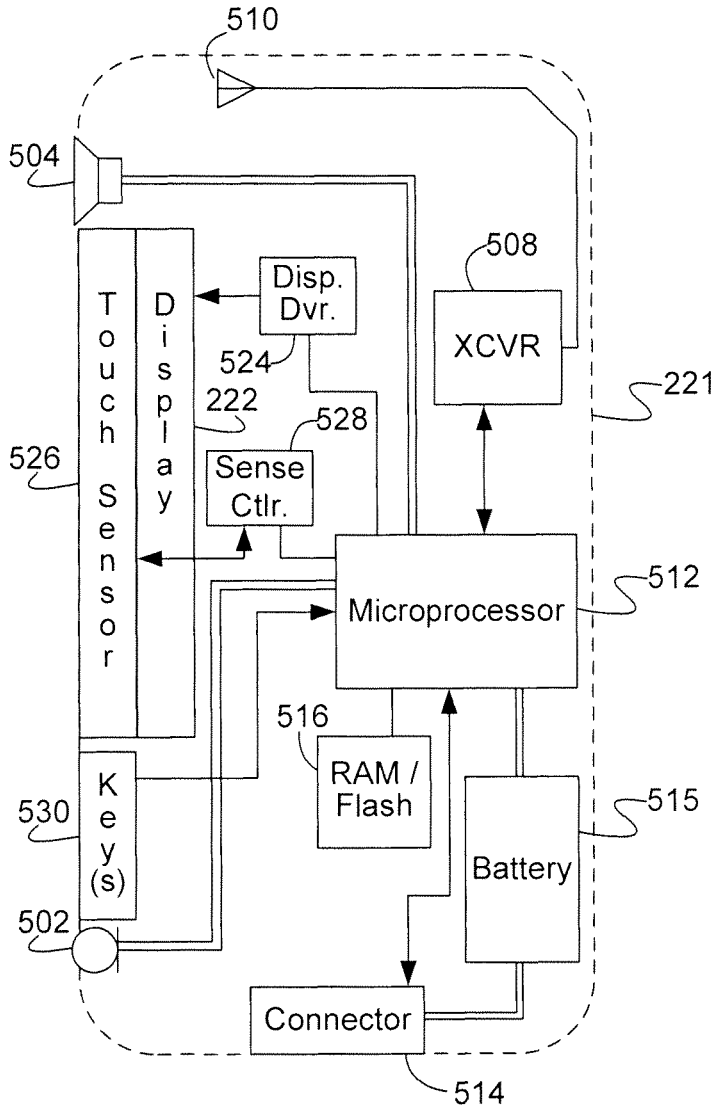
FIG. 5 is a high-level functional block diagram of an exemplary touch-screen type mobile device as may control the external NVD through a removable connection, as shown in FIG. 2.

FIG. 5 is a block diagram of an illustrative mobile device 221. Although the mobile device 221 may be a smart-phone, the mobile device 221 can more generally be a tablet computer, a personal digital assistant (PDA), or another portable user computing device. In some embodiments, the mobile device 221 may function as a normal digital wireless telephone device (e.g., smart-phone embodiments), while in other embodiments the mobile 221 may function as a tablet computer or PDA which is optionally configured to communicate across a digital wireless telephone network (e.g., 3G- or 4G-enabled tablet computer embodiments). In examples in which the device 221 is configured for telephone use, the device 221 includes a microphone 502 for audio signal input and a speaker 504 for audio signal output.

For digital wireless communications, the device 221 also includes at least one digital transceiver (XCVR) 508 connected to an antenna 510. Today, the device 221 could be configured for digital wireless communications using one or more of the common network technology types including, but not limited to, digital wireless telephone network types (e.g., SS7, GSM/GPRS, 3G, LTE, or the like) and/or wireless IP/Ethernet network types (e.g., Wifi). The concepts discussed here encompass embodiments of the mobile device 221 utilizing any digital transceivers that conform to current or future developed digital wireless communication standards, as well as embodiments in which mobile device 221 does not include a wireless transceiver.

The device 221 includes a built-in display 222 for displaying messages, menus, application screens, user content, or the like, including image data for display on an external NVD display. A user-input interface includes one or more keys 530 and/or touch-screen circuitry 526/528 which enables generation of selection inputs, for example, as may be keyed-in by the user based on functions associated with key(s), a displayed menu, or a cursor control and selection of a highlighted item on a displayed screen. The display 222, keys 530, and touch-screen circuitry 526/528 are the physical elements providing a textual or graphical user-input interface. Of course other user interface elements may be used, such as a trackball or stylus, as in some types of PDAs or smart phones.

As shown in FIG. 5, the device 221 includes a touch-screen display that displays information to a user and can detect occurrence and location of a touch on the area of the display 222. The touch may be an actual touch of the display device with a finger, stylus, or other object, although at least some touch-screens can also sense when the object is in close proximity to the screen. Use of a touch-screen display as part of the user interface enables a user to interact directly with the information presented on the display. The touch-screen display may rely on a display driver 524, controlled by microprocessor 512 to present visible outputs to the device user. A touch/position sensor 526 is relatively transparent, so that the user may view the information presented on the display 222. A sense circuit 528 senses signals from elements of the touch/position sensor 526 and detects occurrence and position of each touch of the screen formed by the built-in display 222 and sensor 526. The sense circuit 528 provides touch position information to the microprocessor 512, which can correlate that information to the information currently displayed via the display 222 to determine the nature of user input via the screen.

The device 221 further includes one or more connector(s) 514 that can be used to connect peripheral devices to the mobile device. The connector 514 provides an input/output interface for exchanging of data and commands over a wired link with a peripheral device. For example, the connector 514 can be used as an input/output interface for data and commands when coupled to an external computer, docking station, input or output device (e.g., an external keyboard, speaker, or microphone). The connector 514 can further be used as an input/output interface for communicating control commands and image data to an accessory 101 including an NVD 103 connected to the device 221, so as to cause the image data to be displayed on the NVD 103. The connector 514 further provides a power connection for receiving power from a charger, power supply, or other peripheral device providing power to charge the battery 515 of the device 221. Additionally, the connector can be used to provide power from the battery 515 to a peripheral device, for example to provide power to an accessory 101 including an NVD 103 connected to the device 221 via the connector 514.

The microprocessor 512 serves as a programmable controller for the device 221, in that it controls all operations of the device 221 in accord with programming that it executes, for all normal operations, and for operations involved in controlling the operation of an external NVD display. The device 221 includes a memory 516 (e.g., a non-transitory flash type program memory) for storage of various "software" or "firmware" program routines and configuration settings. The memory 516 may also include a non-volatile random access memory (RAM) for a working data processing memory. Of course, other storage devices or configurations may be added to or substituted for those in the example. In a present implementation, the flash type program memory stores firmware such as a boot routine, device driver software, an operating system, and any of a wide variety of other applications, such as client browser software and short message service software. The memory 516 also stores various data, such as downloaded data and multimedia or user content, and various data input by the user. Programming stored in the flash type program memory, sometimes referred to as "firmware," is loaded into and executed by the microprocessor 512.

As outlined above, the device 221 includes a processor, and programming stored in the memory 516 configures the processor so that the device is capable of performing various desired functions, including in this case the functions involved in the technique for controlling an external NVD such as the NVD 103 in the accessory 101 of FIGS. 1A-1C and 2. In particular, execution of programming stored in memory 516 on microprocessor 512 may cause the device 221 to perform functions such as those described as part of methods 300 and 400 above, including functions relating to controlling an external NVD by causing power and image data to be provided to the external NVD through connector 514.

The structure and operation of the mobile device 221, as outlined above, is described to by way of example, only. Other types of mobile devices, including devices that are not necessarily operative to communicate over a mobile wireless communication network, are also considered.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

What is claimed is:

1. An accessory for a mobile device, comprising:

a recess for accommodating the mobile device;

an integrated non-volatile display (NVD) located on a face of the accessory opposite to the recess;

a device connector attached in the recess and configured to be coupled to the mobile device when positioned in the recess and to receive from the mobile device both image data for display on the NVD and power for powering of the NVD when the mobile device is coupled to the device connector; and a display controller electrically coupled to the device connector and to the NVD, and configured to display the received image data on the NVD in response to receiving both the image data and power through the device connector, wherein the NVD is a display that uses power in order to change an image displayed thereon, and uses substantially no power in order to maintain display of an image thereon, wherein the NVD is operative to receive power transiently from the mobile device via the device connector for a limited period of time including a first time at which the image data is transmitted to the NVD and a second time at which a changed image data is transmitted to the NVD, and to receive substantially no power during a period of time between the first and second times.

2. The accessory of claim 1, wherein the display controller is configured to change an image displayed on the NVD only when power is received through the device connector at the same time as image data for a new image is received through the device connector.

3. The accessory of claim 1, further comprising:

a power manager electrically coupled to the device connector and to the display controller, and configured to provide power received through the device connector to the display controller and the NVD.

4. The accessory of claim 1, further comprising:

a power connector for removably connecting a power supply to the accessory, wherein the power connector is coupled to the device connector to provide power received through the power connector to the mobile device connected to the device connector when power is received through the power connector.

5. The accessory of claim 4, further comprising:

a switch operative to selectively decouple the display controller and the device connector, wherein the switch is operative to decouple the display controller and the device connector when power is received through the power connector.

6. The accessory of claim 1, wherein the NVD is a display that relies on electronic paper display (EPD) technology for operation.

7. A mobile device comprising:

a built-in display;

a user-input interface; and a connector, wherein the mobile device is configured to control an external non-volatile display (NVD) when connected thereto via the connector by performing functions to:

after displaying content on the built-in display, receive through the user-input interface a user-input command for displaying a particular image on the NVD; and responsive to receiving the user-input command, transmit image data corresponding to the particular image to the external NVD via the connector while transiently providing power to the NVD via the connector, wherein the mobile device provides to the external NVD via the connector transient power for a limited period of time including a first time at which the image data is transmitted to the NVD and a second time at which a changed image data is transmitted to the NVD, and provides substantially no power during a period of time between the first and second times.

8. The mobile device of claim 7, wherein the mobile device transiently provides power to the external NVD via the connector such that the mobile device at least substantially withdraws power provided to the external NVD in response to receiving an acknowledgement message from the external NVD.

9. The mobile device of claim 7, wherein the mobile device is further configured to control the external NVD connected thereto by performing functions to:

responsive to receiving a user input command to change the particular image displayed on the NVD through the user-input interface of the mobile device, transmit image data corresponding to the changed image to the external NVD via the connector while transiently providing power to the NVD via the connector.

10. The mobile device of claim 9, wherein the user input command to change the particular image displayed on the NVD is a user input command to scroll up or to scroll down within a document or to change a page of the document.

11. The mobile device of claim 7, wherein the mobile device is further configured to power down the built-in display in response to receiving the user-input command.

12. The mobile device of claim 7, wherein the mobile device is a tablet computer or a smart-phone.

13. A method comprising steps of:

displaying content on a built-in display of a mobile device configured to control a non-volatile display (NVD) external to the mobile device when the NVD is connected to the mobile device;

responsive to displaying the content on the built-in display, receiving through a user-input interface of the mobile device a user-input command for displaying a particular image on the NVD; and responsive to receiving the user-input command, transmitting image data corresponding to the particular image from the mobile device to the NVD while transiently providing power from the mobile device to the NVD, wherein the mobile device provides to the NVD transient power such that power is provided to the NVD for a limited period of time including a first time at which the image data is transmitted to the NVD and a second time at which a changed image data is transmitted to the NVD, and provides substantially no power during a period of time between the first and second times.

14. The method claim 13, wherein power is transiently provided from the mobile device to the NVD such that the mobile device at least substantially withdraws power provided to the NVD in response to receiving an acknowledgement message at the mobile device from the NVD.

15. The method claim 13, further comprising:

responsive to receiving a user input command to change the particular image displayed on the NVD through the user-input interface of the mobile device, transmitting image data corresponding to changed image from the mobile device to the NVD while transiently providing power from the mobile device to the NVD.

16. The method of claim 15, wherein the user input command to change the particular image displayed on the NVD is a user input command to scroll up or to scroll down within a document or to change a page of the document.

* * * * *